United States Patent [19]

Gay

[11] 4,061,944

[45] Dec. 6, 1977

[54] ELECTRON BEAM WINDOW STRUCTURE FOR BROAD AREA ELECTRON BEAM GENERATORS

[75] Inventor: Gardiner Gay, Cambridge, Mass.

[73] Assignee: Avco Everett Research Laboratory, Inc., Everett, Mass.

[21] Appl. No.: 590,030

[22] Filed: June 25, 1975

[51] Int. Cl.[2] ..... H01J 33/00

[52] U.S. Cl. ..... 313/420; 315/85; 313/363

[58] Field of Search ..... 313/420, 359, 363; 315/85, 157

[56] References Cited

U.S. PATENT DOCUMENTS

| | | | |
|---|---|---|---|
| 3,469,139 | 9/1973 | Colvin | 313/420 |
| 3,588,565 | 6/1971 | Trump | 313/420 |
| 3,788,892 | 1/1974 | Van Raalte et al. | 117/212 |

*Primary Examiner*—Rudolph V. Rolinec
*Assistant Examiner*—Vincent J. Sunderdick
*Attorney, Agent, or Firm*—Charles M. Hogan; Melvin E. Frederick

[57] ABSTRACT

An electron beam window structure for broad area electron beam generators wherein a stream of electrons generated in an evacuated enclosure and extending over a broad area are passed through a thin window to a region of high pressure outside the enclosure. The structure is positioned between the metal window and the electron emission means of the electron beam generator and comprises a generally flat metal plate of high thermal conductance having closely spaced parallel slots extending over and covering the intended area of the electron beam. The bottom of each slot is disposed adjacent one surface of the plate and over its length and is provided with a row of closely spaced holes of the same diameter as the bottom width of the slot. The holes go through the remaining material leaving a small web between adjacent holes. The metal window is mounted on the slotted side of the plate while the side of the plate with the holes faces the emission means disposed in the evacuated enclosure. The plate preferably is provided with coolant flow passages for the continuous removal from the plate of significant amounts of heat generated by the impact of electrons on the plate and by electrons passing through the metal window.

6 Claims, 2 Drawing Figures

ELECTRON BEAM WINDOW STRUCTURE FOR BROAD AREA ELECTRON BEAM GENERATORS

Figure 1:
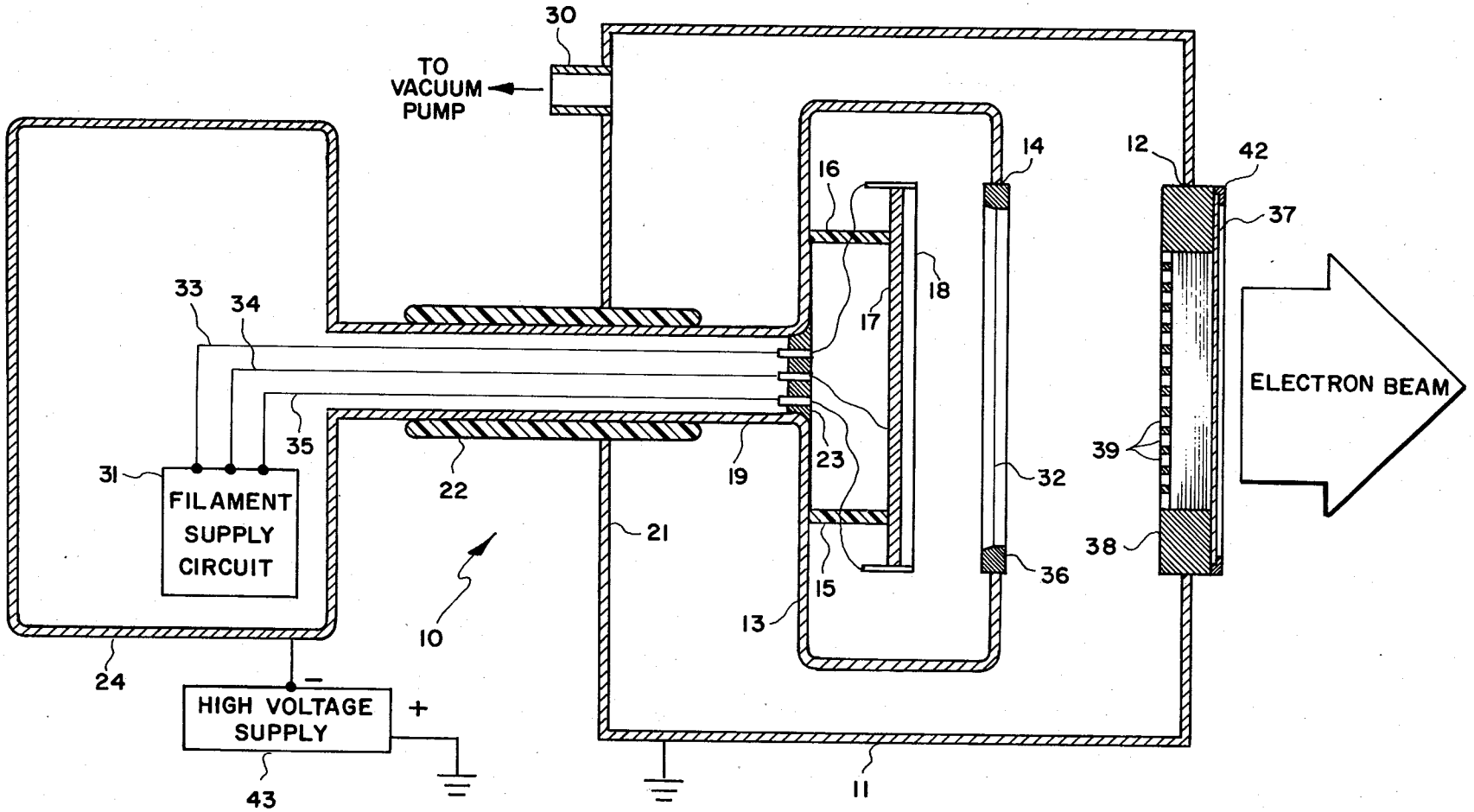

This invention relates to electron discharge devices and, in particular, to electron discharge devices having an improved electron beam window structure for irradiating exterior of the device a volume having a substantial cross-section.

The use of ionizing energy in the form of high-energy electrons finds application in a variety of apparatus and processes including those of radiation chemistry, sterilization, preservation, supporting an electrical discharge in a gas, etc. The development of radiation curable coating compositions such as paints and varnishes has made possible advances in the coating field which, aside from the qualitative benefits, provides the advantages of greatly reduced curing times and substantial reductions in space requirements for curing equipment. The degree to which electron-initiated polymerization replaces conventional baking and other curing methods is, however, dependent upon the availability of electron-emission equipment capable of providing efficient utilization of the power required to provide the polymerization-effecting electrons and effective distribution of the resultant energy in a manner such as to provide a production rate compatible with the intended operation.

The use of ionizing energy in the form of high-energy electrons may find application in the field of magnetohydrodynamics to provide electrically conductive ionized gases; it is used in lasers to provide an appropriate medium for lasing action. The present invention is particularly useful in the production of spatially uniform discharges in gas lasers at pressure levels and sizes such that electron-ion pair diffusion to the confining walls is negligible, which is to say where the discharge is not wall dominated. For a further discussion, reference is made to U.S. Pat. No. 3,749,967 and U.S. Pat. No. 3,702,973, assigned to the same assignee as this patent application.

As taught in the prior art, a high-energy electron source may be provided by accelerating electrons to high energy in an evacuated tube, and permitting the high energy electrons to issue from the tube through an appropriate electron window. The high-energy electrons may be caused to issue from the tube in the form of a sheet. In one such device, electrons are accelerated as a small beam within an evacuated tube and then a rapid scanning movement is imparted to an electron beam before it passes to the electron window and issues from the tube. In another such prior art device, an electron beam is focused into a sheet from within the tube by a system for cylindrical electron optics. See Robinson, U.S. Pat. Nos. 2,620,751 and 2,680,814. Where precise focusing is not essential, the electron-emitting cathode or cathodes are enclosed in a suitable housing which restricts and directs the electron sheet to the electron window. See Trump, U.S. Pat. No. 2,887,599. The Trump electron acceleration tube includes an extended line high-voltage cathode structure within which an electron-emitting filament or filaments are positioned, an evacuated grounded metallic structure which has an extended line window or windows to permit electrons to emerge into air, and one or more equipotential shields interposed between the cathode and the metallic structure and maintained at intermediate voltages.

In a further prior art device of the type here concerned, a window supporting grid and heat sink is provided to increase the sustainable output capacity of the window. Such a support grid comprises a plurality of transversely extending cross members spaced apart at even intervals so as to minimize the maximum distance between any point on the window and the nearest portion of the grid. Spaces intermediate the cross members extend entirely and uniformly through the supporting grid. Thus, all of the window intermediate the cross members is completely and directly exposed to the electron emission means. See Calvin et al U.S. Pat. No. 3,440,466.

The aforementioned U.S. Pat. No. 3,749,976 in part teaches in electron beam devices of the type here concerned the provision of a field free region terminated by a window supported by a thin window supporting member which may be provided with slots that pass entirely through it. The provision of a first grid at a high negative potential, a second grid at ground potential and the supported window (also at ground potential) spaced a considerable distance from the second grid functions to provide a field free region of substantial length intermediate the second grid and the window for the purpose of preventing damage to the window resulting from arcing.

Such an arrangement was found to be subject to numerous disadvantages. Thus, the arrangement was expensive to manufacture, was difficult to maintain at satisfactory operating temperature, required substantial space in the acceleration direction, and the second grid effected partial blockage of the electron beam before it reached the window supporting member.

In operation, it was found that rods used in the second grid tended to break loose. This permitted a charge to form on them and thereby result in an arc between the rod and its supporting structure. This apparently caused a region of high conductivity to form momentarily which adversely affected the electron beam power supply by overloading it.

Further, it was also found that an excessive number of sufficiently high energy electrons impacting on the window caused arcing at the window which damaged it. Apparently, notwithstanding the presence of a field free region, the electrons upon striking the foil caused ionized particles, composed in part of impurities, to be emitted. This is especially likely to happen when a new window has been installed and electron bombardment causes outgassing. Such particles having a positive charge are accelerated away from the window, collide with the electrons and cause local ionization. This ionization, immediately adjacent the window, resulted in arcing.

The present invention is an improvement over the said U.S. Pat. No. 3,749,967 and overcomes the above-noted disadvantages.

Thus, electron beam generators constructed in accordance with the present invention wherein the field free region and window supporting member are uniquely formed and combined in a single part, permits a substantial reduction in fabricating costs, more effective heat removal, substantial reduction in the space required and essentially complete elimination of window loss or damage. All of the preceding is accomplished with no increase, if not a reduction as compared to prior art structures, in window loss or damage.

Figure 2:
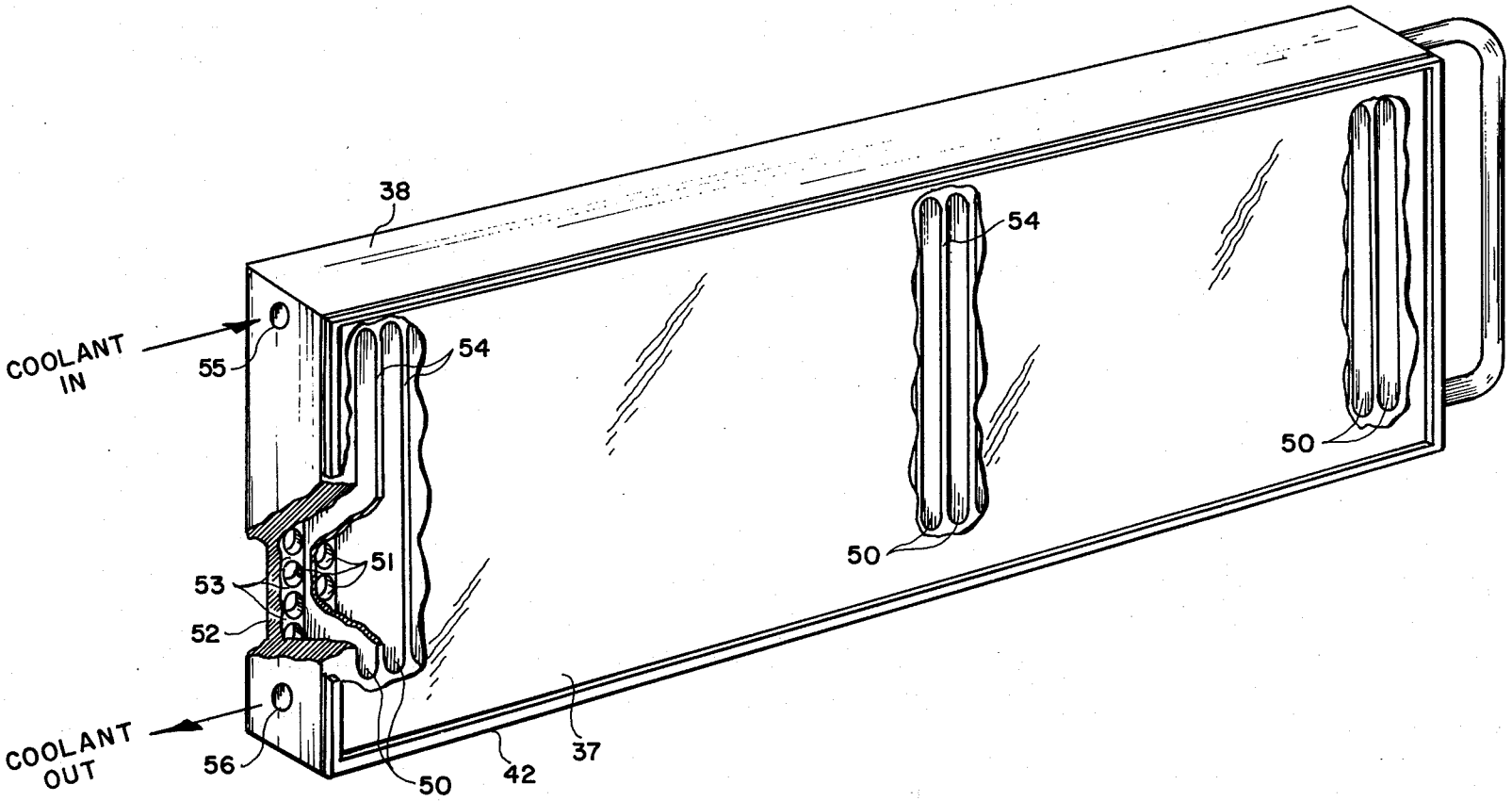

The novel features that are considered characteristic of the invention are set forth in the appended claims; the invention itself, however, both as to its organization and method of operation, together with additional objects and advantages thereof, will best be understood from the following description of a specific embodiment, when read in conjunction with the accompanying drawings, in which:

FIG. 1 is a schematic illustration in sectional side view of an electron beam generator for providing a broad area electron beam exterior of the generator through an electron window in accordance with the invention; and FIG. 2 is a perspective illustration with parts broken away of a window and window supporting member shown in FIG. 1 and defining a field free region.

Referring now to FIG. 1, there is shown an electron beam discharge device designated generally by the numeral 10 and comprising in this case a rectangular metallic main housing 11 having a rectangular aperture 12 sealably closed by electron window means in accordance with the invention more fully described hereinafter.

Disposed within the housing is a rectangular metallic enclosure 13 having an aperture 14 concentric with the axis of the aperture 12 in the main housing 11. Positioned and supported within the enclosure 13 by electrically nonconductive stand-offs 15 and 16 and an electrically conductive plate 17 are at least one and preferably a plurality of filaments 18 uniformly spaced one from another, insulated from plate 17, and connected to a source of filament current. The filaments 18 are heated in conventional manner by a normally low voltage source to produce thermionic emission. As shown in FIG. 1, the enclosure 13 is supported by an axially disposed tubular extension 19 sealably passing through the rear wall 21 of the main housing and electrically insulated therefrom by insulating material 22 arranged and adapted to withstand not only the provision of a high vacuum in the main housing 11, but also a high potential difference of, for example, 100 or more kilovolts between the main housing 11 and the tubular extension 19. The filaments 18 may be formed of tungsten, thoriated tungsten, or other suitable filament material and spring loaded (not shown) to compensate for expansion and contraction during operation of the device. The tubular extension 19 is suitably sealed as by wall 23 adapted to permit electrical connection to the filaments while permitting a vacuum to be maintained inside of the main housing 11. The end of the tubular extension 19 remote from enclosure 13 is electrically connected to and terminates at a further metallic enclosure 24 exterior of the housing 11. Within enclosure 24, the interior of which may be at atmospheric pressure, is disposed the filament power supply 31. Conductors 33, 34, and 35 appropriately couple the filament power supply 31 to the filaments 18 and plate 17.

The interior of the main housing 11 and enclosure 13 is evacuated via pipe 30 by a vacuum pump (not shown) in conventional manner and maintained at a low pressure to prevent electrical breakdown between enclosure 13 and housing 11. Disposed within and covering aperture 14 of enclosure 13 is a metallic screen 32 carried by support means 36. Screen 32 is permeable to electrons generated by the filaments 18.

The screen 32 is in electrical connection with the enclosure 13.

Disposed within and sealably covering aperture 12 in main housing 11 is a window 37 supported on a reticulated metallic plate 38 (more fully shown in FIG. 2) in electrical connection with the main housing 11 and comprising electron window means. The window 37 may, for example, be of aluminum, beryllium, titanium, an alloy or a thin sheet of plastic such as Kapton or Mylar. The window 37 is positioned so as to completely cover aperture 12 and extend on each side thereof a sufficient distance to be removably secured against the main housing 11 by a suitable window retaining ring 42. The window retaining ring 42 and/or plate 38 may be removably and sealably affixed to the main housing 11 by suitable sealing and fastener means; e.g. O-rings, bolts, screws, clamps or the like.

Enclosures 13 and 24, extension 19 and grid 32 are electrically connected to the negative terminal of a conventional high voltage supply 43 adapted to provide a negative potential of, for example, about 70–100 kilovolts. The positive terminal of the high voltage supply 43 as well as the main housing 11 are grounded to provide a large potential difference of, for example, 70–100 kilovolts between grid 32 and plate 38.

Attention is now directed to FIG. 2 which shows details of novel window structure in accordance with the invention comprising a field free region. As taught in the aforementioned U.S. Pat. No. 3,749,967, the provision of a field free region within the evacuated enclosure and immediately adjacent the window is advantageous in preventing arcs which may form within the enclosure from reaching and puncturing the window. However, as and for the reasons noted hereinabove, the provision of a field free region as taught in the aforementioned patent has not been found entirely satisfactory. A window structure in accordance with the invention and as illustrated by way of example in FIG. 2 overcomes the deficiencies of the noted prior art structure.

As shown in FIG. 2, the window support plate may comprise a flat metal plate of high thermal conductivity such as aluminum which for an acceleration voltage of about 70–100 kilovolts need be only about one inch thick in the electron acceleration direction. Plate 38 is provided with closely spaced (about 0.062 inch, for example) parallel slots 50 which may be conveniently machined into the plate 38 a distance sufficient to conveniently permit a series of closely spaced holes 51 to be drilled or otherwise formed in the plate material forming the base 52 of each slot 50. Thus, for a plate 1.0 inch thick, the slots may conveniently be formed with a depth of about 0.875 inch. The holes which may be most conveniently formed by drilling preferably have a diameter at least substantially the same as the width of the slots and are spaced apart about a distance sufficient to leave a small web 53 between adjacent holes. The thickness of the material or portions 54 between adjacent slots is preferably kept to the smallest convenient dimension.

While the manner of forming the slots and holes is not critical, the provision of holes with a web disposed between adjacent holes is essential.

The window is disposed on the side of the plate with the slots 50. The width of the slots are preferably selected to be of the greatest dimension that will still provide the necessary support and cooling for the window. The drilled side or side with the holes 51 must face the electron source.

It has been found highly advantageous in increasing the useful life of a window if the end portions of the webs supporting the window are curved to present a smooth curved surface. It has been further found highly advantageous in preventing arcs if the edges of the holes facing the electron source are also curved to present a smooth curved surface.

The webs 53 intermediate the holes in the plate serve as fixed potential points and limit the spread of the accelerating electrical field into the slots 50 and, therefore, notwithstanding the relatively small thickness of the plate 38 which would otherwise permit the acceleration field to reach or at least effectively reach the window, prevents the acceleration field from reaching or effectively reaching the window.

Thus, for example, when a new window has been installed and the electron beam is being conditioned, outgassing of the bombarded window surface occurs. The outgassed material is ionized by the high energy electrons approaching the window and tends to form a conductive path. If the secondary electrons formed by the ionization of the outgassed material are accelerated and cause more ionization, the conductivity at this point will increase until a breakdown or arc occurs. However, if the secondary electrons are not allowed to ionize more particles as is the case in accordance with the present invention, the conductivity will remain low in the field free region. Thus, if a breakdown or arc should occur, it will not follow a conductive region to the window and cause its failure.

Coolant flow passages 55 and 56 are provided adjacent the ends of the slots and are adapted to be coupled to a pressurized source of coolant (not shown). Accordingly, much of the energy imparted to the plate and window by electrons impinging on them flow through the plate to the coolant and is thereby removed. In a laser device of the type here concerned, having an output power of about 10 kilowatts and an electron beam current of about 0.06 to 0.08 milliamperes per square centimeter, the temperature rise in the plate may be expected to be of the order of about 40° C.

Embodiments other than that shown and described herein are possible and are within the scope of the invention. Thus, the plate 38 may be provided with large holes on the window side and a plurality of small holes within the confines of the large hole on the electron source side. Alternately, deep slots may be provided on the window side with crosswise slots provided on the electron source side which crosswise slots are only deep enough to break through into the deep slots. Still further, the holes 51 may be non-circular, such as, for example, square. In any event, the holes however formed and of whatever configuration must be small enough to at least effectively prevent the acceleration field from reaching the window. Further, to reduce the possibility of arcing to a minimum, all of the slot and hole exterior edges are preferably rounded and care is taken to be sure that no chips or foreign matter remain in the slots or holes.

The various features and advantages of the invention are thought to be clear from the foregoing description. Various other features and advantages not specifically enumerated will undoubtedly occur to those versed in the art, as likewise will many variations and modifications of the preferred embodiment illustrated, all of which may be achieved without departing from the spirit and scope of the invention as defined by the following claims:

I claim:

1. In an electron acceleration device for delivering to a region outside of the device an electron beam of substantial cross-section comprising a housing having an aperture, electron emission means within said housing and spaced from said aperture, an electron window adapted to be disposed within said aperture and defining with said housing an essentially gas-tight emission chamber, said electron window providing an exit from said housing through which said electron beam is transmitted when said housing is evacuated, said electron emission means actuated and an acceleration potential defining an electric acceleration field provided for accelerating electrons toward said electron window, the improvement which comprises:

a flat electrically conductive metal electron window support adapted to be sealably mounted in said housing aperture, said support having a high thermal conductance, a first surface for sealably receiving said electron window and a second surface facing said electron emission means;

said support having a plurality of elongated slots of a length and number to define the cross-section of said beam, said slots each being spaced apart a distance to define thin thermally conducting metal cross members each having an exposed end portion in contact with and supporting said window;

thermally and electrically conductive metal portions defining the bottom of each slot and comprising in part said second surface, each said metal portion having a plurality of closely spaced holes extending along the length of said slots and providing communication between the interior of said housing and said slots, said holes being of a size and spaced one from another to prevent the electric acceleration field from extending into said slots a substantial portion of the depth of said slots; and conduit means positioned in relation to said cross members through which fluid coolant can be passed in heat-exchange relationship with said cross members.

2. Apparatus as defined in claim 1 wherein said metal portions defining the bottom of each slot are integral with said support and said holes have a diameter substantially equal to the width of said slots.

3. Apparatus as defined in claim 1 wherein said metal portions defining the bottom of each slot are integral with and a part of said support, said support is composed of aluminum, the end surface of the exposed end portions of said cross members are curved, and the edges of said holes facing said electron emission means are curved.

4. Apparatus as defined in claim 3 wherein said slots are all of substantially the same width and length and evenly spaced one from another, and said holes have a diameter substantially equal to the width of said slots.

5. Apparatus as defined in claim 4 wherein said conduit means includes first and second coolant flow passages in said support adjacent the ends of the slots.

6. Apparatus as defined in claim 4 wherein said acceleration potential is in the range of about 70–100 kilovolts, said window support is about one inch thick in the direction of electron acceleration through said window, and said metal portions defining the bottom of said slots is about one-eighth of an inch thick in the said direction of electron acceleration.

* * * * *